US009464381B2

(12) United States Patent
Liu et al.

(10) Patent No.: US 9,464,381 B2
(45) Date of Patent: Oct. 11, 2016

(54) FABRIC PRETREATMENT SOLUTION

(71) Applicant: EASTERN TECH LLC, Milford, CT (US)

(72) Inventors: Shawn Liu, Stamford, CT (US); Andrew Chastain, New Haven, CT (US)

(73) Assignee: EASTERN TECH LLC, Milford, CT (US)

( * ) Notice: Subject to any disclaimer, the term of this patent is extended or adjusted under 35 U.S.C. 154(b) by 0 days.

(21) Appl. No.: 14/796,315

(22) Filed: Jul. 10, 2015

(65) Prior Publication Data

US 2016/0032523 A1 Feb. 4, 2016

Related U.S. Application Data

(60) Provisional application No. 62/030,824, filed on Jul. 30, 2014.

(51) Int. Cl.

| | |
|---|---|
| ***D06P 5/30*** | (2006.01) |
| ***D06P 1/673*** | (2006.01) |
| ***D06P 1/52*** | (2006.01) |
| ***D06P 1/613*** | (2006.01) |
| ***D06P 1/60*** | (2006.01) |
| *B41J 3/407* | (2006.01) |
| *B41M 5/00* | (2006.01) |

(52) U.S. Cl.

CPC ..... *D06P 5/30* (2013.01); *D06P 1/5271* (2013.01); *D06P 1/5285* (2013.01); *D06P 1/60* (2013.01); *D06P 1/613* (2013.01); *D06P 1/6735* (2013.01); *B41J 3/4078* (2013.01); *B41M 5/0017* (2013.01)

(58) Field of Classification Search

None

See application file for complete search history.

(56) References Cited

U.S. PATENT DOCUMENTS

| | | | | |
|---|---|---|---|---|
| 6,214,417 | B1 * | 4/2001 | Watanabe | D06P 1/48 347/105 |
| 2007/0056118 | A1 * | 3/2007 | Ellis | C09D 11/322 8/115.51 |
| 2007/0067928 | A1 | 3/2007 | Ellis | |

* cited by examiner

*Primary Examiner* — An Do
*Assistant Examiner* — Renee I Wilson
(74) *Attorney, Agent, or Firm* — Cantor Colburn LLP

(57) ABSTRACT

Disclosed is a pretreatment solution for treating a fabric before inkjet printing comprising an aqueous solution of (A) 1% to 60% by weight of at least one multivalent cationic salt; (B) 0.2% to 10% by weight of at least one acid; and (C) and 0.5% to 5% by weight at least one borate, all % are by weight of the aqueous pretreatment solution.

19 Claims, No Drawings

FABRIC PRETREATMENT SOLUTION

CROSS REFERENCE TO RELATED APPLICATION

This application claims the priority benefit of U.S. Provisional Application No. 62/030,824 filed on Jul. 30, 2014. That priority U.S. Provisional Application is incorporated by reference herein in its entirety.

BACKGROUND OF THE INVENTION

Pretreatment solutions are commonly used before inkjet printing of fabrics such as cotton. See US Published Patent Application Ser. No. 20070067928 A1. Such pretreatment solution products include duPont ARTISTRI P5001 pigment pretreatment solutions, sold by E. I. du Pont de Nemours and Company. This duPont ARTISTRI P5001 pretreatment product contain inorganic nitrate salts. Another duPont pretreatment product is duPont ARTISTRI P5002, which comprises calcium chloride and a urethane polymer. Other pretreatment solution products include IMAGE ARMOR Dark Shirt Formula and IMAGE ARMOR Dark Shirt Formula sold by Image Armor LLC. These Image Armor pretreatment solutions contain nitric acid, ammonium calcium salt. Still another pretreatment solution is FIREBIRD Ink Dark Garment Pretreatment sold by Eastern Tech LLC, which comprises calcium nitrate salts. While these pretreatment products indicated to work with treating black or dark fabrics, they generally are not suitable to use with white or light colored fabrics because they can discolor the fabric during the heating of the solution pretreatment on non-black cotton garments. Other fabric pretreatment products such as FIREBIRD ink light garment pretreatment and IMAGE ARMOR Light Shirt pretreatment solutions can be used with white or light colored fabrics. However they are not as reactive to white textile inks and cannot yield a bright white print. Thus, there is a need to have a pretreatment solution that is reactive to white textile inks while not discoloring light or white fabrics. The present invention provides a solution to that need.

BRIEF DESCRIPTION OF THE INVENTION

The present embodiments include a pretreatment solution for treating a fabric before inkjet printing comprising an aqueous solution of (A) 1% to 60% by weight of at least one multivalent cationic salt; (B) 0.2% to 10% by weight of at least one acid; and (C) and 0.5% to 5% by weight at least one borate, all % are by weight of the aqueous pretreatment solution.

DETAILED DESCRIPTION OF THE INVENTION

The present invention provides a fabric pretreatment solution that can be used on a wide variety of dark-colored, medium-colored and light-colored fabrics such black, charcoal grey, and light blue 100% cotton t-shirts, respectively, is sufficiently reactive with white inkjet inks that it will yield a bright white print on the fabric, and will not discolor or stain the fabric.

The present fabric pretreatment solution is an aqueous solution of selected amounts of at least three components, namely, at least one multivalent cationic salt; at least one acid; and at least one borate. The pretreatment solution can contain selected amounts of other optional ingredients, namely, resins, solvents/penetrants, humectants and finishing agents.

The at least one multivalent cationic salt can include any salt wherein the multivalent cation comprises one or more of the group of multivalent cations of elements Mg, Ca, Sr, Ba, Sc, Y, La, Ti, Zr, V, Cr, Mn, Fe, Ru, Co, Rh, Ni, Pd, Pt, Cu, Au, Zn, Al, Ga, In, Sb, Bi, Ge, Sn and Pb. "Multivalent" indicates an oxidation state of two or more and, for an element "Z", are typically described as Z.sup.2+, Z.sup.3+, Z.sup.4+and so forth. For brevity, multivalent cations may be referred to herein as Z.sup.x. The multivalent cations are substantially soluble in the aqueous pretreatment solution and preferably exist (in solution) in a substantially ionized state so that they are in a form where they are free and available to interact with textile when the textile is exposed to the pretreatment solution. Any suitable divalent salt can be used. Calcium is a particularly useful multivalent cation for many present embodiments.

For many embodiments, the at least one multivalent cationic salt is chosen from the group consisting of calcium nitrate, calcium nitrate hydrate, calcium nitrate tetrahydrate, calcium chloride or a combination comprising at least one of the foregoing. Calcium nitrate tetrahydrate is particularly useful because of cost, performance and availability considerations.

For some embodiments, the amount of the at least one multivalent cationic salt is 5% to 20% by weight of the aqueous pretreatment solution. Calcium nitrate tetrahydrate can be used in amounts from 8% to 15% by weight of the aqueous pretreatment solution in some embodiments.

For many embodiments, the at least one acid comprises acetic acid alone or in admixture with boric acid or lactic acid. The combination of a calcium salt with the borate component with form an undesirable solid precipitate in the aqueous solution unless the solution has the right acidic pH it has been found that acetic acid , either alone or in mixtures with boric acid, is particularly suitable at pHs of 5.0 to 6.5. If mixtures of acetic acid and boric acid are used, weight ratios of acetic acid to boric acid from 20:1 to 3:1 can be suitable for some embodiments. If mixtures of acetic acid and lactic acid are used, weight ratios of acetic acid to lactic acid from 20:1 to 3:1 can be suitable for some embodiments.

For some embodiments, the amount of the at least one acid is 0.5% to 2% by weight of the aqueous pretreatment solution.

The at least one borate can be chosen from anhydrous sodium tetraborate, sodium tetraborate pentahydrate, sodium tetraborate decahydrate, calcium tetraborate (gerstley borate), anhydrous disodium tetraborate, disodium tetraborate pentahydrate, disodium tetraborate decahydrate, disodium octaborate tetrahydrate, ammonium pentaborate, boric oxide, boric acid, potassium pentaborate, potassium tetraborate, sodium metaborate tetrahydrate, sodium metaborate octahydrate or a combination comprising at least one of the foregoing. For many embodiments, the at least one borate comprises anhydrous sodium tetraborate, sodium tetraborate pentahydrate, and sodium tetraborate decahydrate or a combination comprising at least one of the foregoing. It has been found that the combination of the borate and acid are reason for the primary improvement over existing fabric pretreatments by causing the staining reduction in light colored fabrics.

For some embodiments, the amount of the at least one borate is 1% to 5% by weight of the aqueous pretreatment solution.

In some optional embodiments, the aqueous pretreatment solution further comprises an aqueous resin dispersion. In some embodiments, the aqueous resin dispersion comprises an aqueous anionic aliphatic polycarbonate-polyether polyurethane dispersion or a self-crosslinking acrylic emulsion, or a latex butadiene-styrene copolymer or combinations thereof. The dispersion is preferably salt stable and washes well. The use of aqueous resin dispersion can improve the wash resistance of printed inks.

If used, the amount of the aqueous resin dispersion can be 1.5% to 10% by weight (based on solids) of the aqueous pretreatment solution.

In some other optional embodiments, the aqueous pretreatment solution further comprises at least one organic solvent/penetrant. In some embodiments, the at least one organic solvent/penetrant is a mixture of propylene glycol methyl ether and dipropylene glycol methyl ether. Other suitable solvent/penetrant can be almost any miscible solvent including ethanol, ethylene glycol, propylene glycol or acetone.

If used, the amount of the propylene glycol methyl ether can be 0.1% to 1% by weight of the pretreatment solution and the amount of the dipropylene glycol methyl ether can be 0.5% to 1.5% by weight of the pretreatment solution.

In some other optional embodiments, wherein the aqueous pretreatment solution further comprises at least one humectant. The humectant can be chosen from propylene glycol, ethylene glycol, polyethylene glycol (various) or derivatives of those compounds. For some embodiments, propylene glycol is the humectant. The presence of the humectant is believed to improve the stain protecting effects of the pretreatment solution.

If used, wherein the amount of the at least one humectant can be from 0.1% to 15% by weight of the pretreatment solution.

In some other optional embodiments, the aqueous pretreatment solution further comprises at least finishing agent. The at least one finishing agent comprises fragrances, surfactants, preservatives, biocides, dyes and rheology modifiers. The addition of fragrances is beneficial in reducing the appearance of a vinegar smell from the acetic acid, such as water-soluble lavender oil and other essential oils.

If used, the amount of finishing agent can be from 0.01% to 1% by weight of the pretreatment solution.

The pretreatment solution can be easily prepared. The borate must be fully dissolved in the water prior to incorporation with the multivalent cationic salt, the acid and the remainder of the water, and, if used, the solvent/penetrant, humectant and finishing agents. Prior to addition of resin dispersion, the pH of the solution should be in the range where the resin dispersion will not precipitate or fall out of solution. When acetic acid is used, the pH is preferably in the range of 5.0 to 6.5. This ensures thorough reactivity and stability of final pretreatment product.

After all of the components in a pretreatment solution are together in solution, that solution is optionally subjected to filtration to remove any undesirable large particles in solution. This can be accomplished by passing the solution through any suitable filter of 40 micron size, more preferably, 10 micron in size, and most preferably, 5 microns in size.

After filtration, the pretreatment solution can be used as follows: (1) the pretreatment solution contacts a fabric sample, the contacting can be carried out by either spraying the pretreatment solution onto the fabric or the fabric can be dipped into the pretreatment solution; (2) heating the pretreated fabric with a heat press or conveyer dryer apparatus to a temperature of 250 degrees F. to 400 degrees F.; (3) inkjet printing the heated fabric to apply a printed design onto the fabric; and (4) heating the pretreated and printed fabric with a heat press or conveyer dryer apparatus to a temperature of 250 degrees F. to 400 degrees F. to fix the ink into the fabric.

Example 1. A pretreatment solution was prepared having the following components mixed together. Sodium tetraborate decahydrate (3% by weight of the final solution) was added to sufficient water to totally dissolve it. Then, calcium nitrate tetraborate (10.5% by weight of the final solution), acetic acid (slightly less than 1% by weight of the final solution), propylene glycol methyl ether (0.5% by weight of the final solution), dipropylene glycol methyl ether (1% by weight of the final solution), propylene glycol (10% by weight of the final solution) and the remaining water were combined with the dissolved sodium tetraborate decahydrate. The pH of the solution was checked and determined to be in the range of 5.0 to 6.5. Then an aqueous anionic aliphatic polycarbonate-polyether polyurethane dispersion (4% by weight (based on solids) of the final pretreatment solution was added to the other components. This solution was then filtered through a 5 micron filter to remove any unwanted large particles.

Preliminary testing of this Example 1 formulation. Example 1 pretreatment was tested against commercially available pretreatments: DuPont™ Artistri™ Pretreatment P5001 pigment pretreatment solutions sold by E. I. du Pont de Nemours and Company. IMAGE ARMOR Ultra Dark Shirt Formula pretreatment solutions sold by Image Armor LLC. FIREBIRD Ink dark garment pretreatment sold by Eastern Tech LLC.

Each pretreatment was individually sprayed onto 100% Cotton Gildan Light Blue t-shirt, using a Viper XPT-6000 automatic pretreatment machine (manufactured by I-Group Technologies). 25 grams of each pretreatment was applied to a 14 inch×17 inch area on the front of the t-shirt, followed by a 45 second heat press cure at 330 degrees F. with medium pressure (setting 4 out of 10) on a STX-20 Hotronix™ Auto Open Clam Heat Press (manufactured by Stahls' Hotronix). The following table indicates the results of the pretreatment and visible discoloration.

| Example 1 Pretreatment | Dupont Artistri Pretreatment P5001 | Image Armor Ultra Dark Shirt Formula | FIREBIRD Ink dark garment pretreatment |
|---|---|---|---|
| Discoloration not noticeable | Discoloration noticeable-brownish yellow color | Discoloration noticeable - brownish yellow color | Discoloration noticeable - brownish yellow color |

Set forth below are some embodiments of connectors and methods of making connectors as disclosed herein.

Embodiment 1. A pretreatment solution for treating a fabric before inkjet printing comprising an aqueous solution of (A) 1% to 60% by weight of at least one multivalent cationic salt; (B) 0.2% to 10% by weight of at least one acid; and (C) and 0.5% to 5% by weight at least one borate, all % are by weight of the aqueous pretreatment solution.

Embodiment 2. The pretreatment solution of embodiment 1, wherein the multivalent cation comprises one or more of the group of multivalent cations of elements Mg, Ca, Sr, Ba, Sc, Y, La, Ti, Zr, V, Cr, Mn, Fe, Ru, Co, Rh, Ni, Pd, Pt, Cu, Au, Zn, Al, Ga, In, Sb, Bi, Ge, Sn and Pb.

Embodiment 3. The pretreatment solution of embodiment 2, wherein the multivalent cation is calcium.

Embodiment 4. The pretreatment solution of embodiment 1, wherein the at least one multivalent cationic salt comprises the group consisting of calcium nitrate, calcium nitrate hydrate, calcium nitrate tetrahydrate, calcium chloride, or a combination comprising at least one of the foregoing.

Embodiment 5. The pretreatment solution of any of embodiment s 1 to 4, wherein the amount of the at least one multivalent cationic salt is 5% to 20% by weight of the aqueous pretreatment solution.

Embodiment 6. The pretreatment solution of any of embodiment s 1 to 5, wherein the at least one acid comprises acetic acid alone or in admixture with boric acid.

Embodiment 7. The pretreatment solution of any of embodiments 1 to 6, wherein the at least one acid comprise acetic acid.

Embodiment 8. The pretreatment solution of any of embodiments 1 to 7, wherein the amount of the at least one acid is 0.5% to 2% by weight of the aqueous pretreatment solution.

Embodiment 9. The pretreatment solution of any of embodiments 1 to 8, wherein the at least one borate comprises anhydrous sodium tetraborate, sodium tetraborate pentahydrate, sodium tetraborate decahydrate, calcium tetraborate (gerstley borate), anhydrous disodium tetraborate, disodium tetraborate pentahydrate, disodium tetraborate decahydrate, disodium octaborate tetrahydrate, ammonium pentaborate, boric oxide, boric acid, potassium pentaborate, potassium tetraborate, sodium metaborate tetrahydrate, sodium metaborate octahydrate or a combination comprising at least one of the foregoing.

Embodiment 10. The pretreatment solution of any of embodiments 1 to 9, wherein the at least one borate comprises anhydrous sodium tetraborate, sodium tetraborate pentahydrate, and sodium tetraborate decahydrate or a combination comprising at least one of the foregoing.

Embodiment 11. The pretreatment solution of any of embodiments 1 to 10, wherein the amount of the at least one borate is 1% to 5% by weight of the aqueous pretreatment solution.

Embodiment 12. The pretreatment solution of any of embodiments 1 to 11, wherein the aqueous pretreatment solution further comprises an aqueous resin dispersion.

Embodiment 13. The pretreatment solution of any of embodiments 1 to 12, wherein the aqueous resin dispersion comprises an aqueous anionic aliphatic polycarbonate-polyether polyurethane dispersion or a self-crosslinking acrylic emulsion, or a latex butadiene-styrene copolymer or combinations thereof.

Embodiment 14. The pretreatment solution of any of embodiments 1 to 13, wherein the amount of the aqueous resin dispersion is 1.5% to 10% by weight (based on solids) of the aqueous pretreatment solution.

Embodiment 15. The pretreatment solution of any of embodiments 1 to 14, wherein the aqueous pretreatment solution further comprises at least one organic solvent/penetrant.

Embodiment 16. The pretreatment solution of any of embodiments 1 to 15, wherein the at least one organic solvent/penetrant is a mixture of propylene glycol methyl ether and dipropylene glycol methyl ether or an humectant.

Embodiment 17. The pretreatment solution of any of embodiments 1 to 16, wherein the at least one organic solvent/penetrant is a mixture of propylene glycol methyl ether and dipropylene glycol methyl ether.

Embodiment 18. The pretreatment solution of any of embodiments 1 to 18, wherein the amount of the propylene glycol methyl ether is 0.1% to 1% by weight of the pretreatment solution and the amount of the dipropylene glycol methyl ether is 0.5% to 1.5% by weight of the pretreatment solution.

Embodiment 19. The pretreatment solution of any of embodiments 1 to 18, wherein the aqueous pretreatment solution further comprises at least one humectant.

Embodiment 20. The pretreatment solution of any of embodiments 1 to 19, wherein at least one humectant comprises propylene glycol, ethylene glycol, polyethylene glycol (various) or derivatives of those compounds.

Embodiment 21. The pretreatment solution of any of embodiments 1 to 20, wherein the amount of the at least one humectant is from 0.1% to 15% by weight of the pretreatment solution.

Embodiment 22. The pretreatment solution of any of embodiments 1 to 21, wherein the aqueous pretreatment solution further comprises at least finishing agent.

Embodiment 23. The pretreatment solution of any of embodiments 1 to 22, wherein the at least one finishing agent comprises fragrances, surfactants, preservatives, biocides, dyes and rheology modifiers.

Embodiment 24. The pretreatment solution of any of embodiments 1 to 23, wherein the amount of the at least one finishing agent is from 0.01% to 1% by weight of the pretreatment solution.

Embodiment 25. The pretreatment solution of any of embodiments 1 to 25, wherein the pH of the pretreatment solution is from 5.0 to 6.5.

Embodiment 26. The pretreatment solution of any of embodiments 1 to 25, wherein the number average particle size of solids in the pretreatment solution is less than 40 microns.

Embodiment 27. The process of inkjet printing a fabric comprising (1) pretreating the fabric with the pretreatment solution of any of embodiments 1 to 27 and (2) inkjet printing the pretreated fabric with ink.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the appended claims.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

In general, the compositions or methods may alternatively comprise, consist of, or consist essentially of, any appropriate components or steps herein disclosed. The invention may additionally, or alternatively, be formulated so as to be devoid, or substantially free, of any components, materials, ingredients, adjuvants, or species, or steps used in the prior art compositions or that are otherwise not necessary to the achievement of the function and/or objectives of the present claims.

The singular forms "a," "an," and "the" include plural referents unless the context clearly dictates otherwise. The endpoints of all ranges directed to the same component or property are inclusive and independently combinable (e.g., ranges of "less than or equal to 25 wt %, or 5 wt % to 20 wt %," is inclusive of the endpoints and all intermediate values of the ranges of "5 wt % to 25 wt %," etc.). Disclosure of a narrower range or more specific group in addition to a broader range is not a disclaimer of the broader range or larger group. The suffix "(s)" is intended to include both the singular and the plural of the term that it modifies, thereby including at least one of that term (e.g., the colorant(s) includes at least one colorant). Unless defined otherwise, technical and scientific terms used herein have the same meaning as is commonly understood by one of skill in the art to which this invention belongs. A "combination" is inclusive of blends, mixtures, alloys, reaction products, and the like.

The invention claimed is:

1. A pretreatment solution for treating a fabric before inkjet printing comprising an aqueous solution of (A) 1% to 60% by weight of at least one multivalent cationic salt; (B) 0.2% to 10% by weight of at least one acid; and (C) and 0.5% to 5% by weight at least one borate, all % are by weight of the aqueous pretreatment solution; wherein the pH of the pretreatment solution is from 5.0 to 6.5.

2. The pretreatment solution of claim 1, wherein the multivalent cation comprises one or more of the group of multivalent cations of elements Mg, Ca, Sr, Ba, Sc, Y, La, Ti, Zr, V, Cr, Mn, Fe, Ru, Co, Rh, Ni, Pd, Pt, Cu, Au, Zn, Al, Ga, In, Sb, Bi, Ge, Sn and Pb.

3. The pretreatment solution of claim 2, wherein the multivalent cation is calcium.

4. The pretreatment solution of claim 1, wherein the at least one multivalent cationic salt comprises from the group consisting of calcium nitrate, calcium nitrate hydrate, calcium nitrate tetrahydrate, calcium chloride, or a combination comprising at least one of the foregoing.

5. The pretreatment solution of claim 1, wherein the amount of the at least one multivalent cationic salt is 5% to 20% by weight of the aqueous pretreatment solution.

6. The pretreatment solution of claim 1, wherein the at least one acid comprises from acetic acid alone or in admixture with boric acid or lactic acid.

7. The pretreatment solution of claim 1, wherein the at least one acid comprises acetic acid.

8. The pretreatment solution of claim 1, wherein the amount of the at least one acid is 0.5% to 2% by weight of the aqueous pretreatment solution.

9. The pretreatment solution of claims 1, wherein the at least one borate comprises anhydrous sodium tetraborate, sodium tetraborate pentahydrate, sodium tetraborate decahydrate, calcium tetraborate (gerstley borate), anhydrous disodium tetraborate, disodium tetraborate pentahydrate, disodium tetraborate decahydrate, disodium octaborate tetrahydrate, ammonium pentaborate, boric oxide, boric acid, potassium pentaborate, potassium tetraborate, sodium metaborate tetrahydrate, sodium metaborate octahydrate or a combination comprising at least one of the foregoing.

10. The pretreatment solution of claim 9, wherein the at least one borate comprises anhydrous sodium tetraborate, sodium tetraborate pentahydrate, and sodium tetraborate decahydrate or a combination comprising at least one of the foregoing.

11. The pretreatment solution of claim 1, wherein the amount of the at least one borate is 1% to 5% by weight of the aqueous pretreatment solution.

12. The pretreatment solution claims 1, wherein the aqueous pretreatment solution further comprises aqueous resin dispersion in an amount of the aqueous resin dispersion is 1.5% to 10% by weight (based on solids) of the aqueous pretreatment solution.

13. The pretreatment solution of claims 12, wherein the aqueous polyurethane resin dispersion comprises an aqueous anionic aliphatic polycarbonate-polyether polyurethane dispersion or a self-crosslinking acrylic emulsion, or a latex butadiene-styrene copolymer or combinations thereof.

14. The pretreatment solution of claims 13, wherein the aqueous pretreatment solution further comprises at least one organic solvent/penetrant/humectant comprising propylene glycol, ethylene glycol, polyethylene glycol, propylene glycol methyl ether, dipropylene glycol methyl ether, or a combination comprising at least one of the foregoing.

15. The pretreatment solution of claim 13, wherein the at least one organic solvent/penetrant/humectant is a mixture of propylene glycol methyl ether and dipropylene glycol methyl ether, wherein the amount of the propylene glycol methyl ether is 0.1% to 1% by weight of the pretreatment solution and the amount of the dipropylene glycol methyl ether is 0.5% to 1.5% by weight of the pretreatment solution.

16. The pretreatment solution of claim 13, wherein the at least one organic solvent/penetrant/humectant comprises propylene glycol, ethylene glycol, polyethylene glycol (various) or derivatives of those compounds or a combination comprising at least one of the foregoing, wherein the at least one organic solvent/penetrant/humectant is in the amount of the at least one humectant is from 0.1% to 15% by weight of the pretreatment solution.

17. The pretreatment solution of claim 1, wherein the aqueous pretreatment solution further comprises at least finishing agent that comprises fragrances, surfactants, preservatives, biocides, dyes and rheology modifiers, wherein the amount of the at least one finishing agent is from 0.01% to 1% by weight of the pretreatment solution.

18. The pretreatment solution of claim 1, wherein the number average particle size of solids in the pretreatment solution is less than 40 microns.

19. The process of inkjet printing a fabric comprising pretreating the fabric with the pretreatment solution of claim 1 and inkjet printing the pretreated fabric with white ink.

* * * * *